US010632496B2

(12) United States Patent
Rounce et al.

(10) Patent No.: US 10,632,496 B2
(45) Date of Patent: Apr. 28, 2020

(54) RELATING TO FLOW OPTIMIZED WASHCOATING

(71) Applicant: Ford Global Technologies, LLC, Dearborn, MI (US)

(72) Inventors: Paul Lindsey Rounce, Basildon (GB); Jon O'Neill, Erith (GB)

(73) Assignee: Ford Global Technologies, LLC, Dearborn, MI (US)

( * ) Notice: Subject to any disclaimer, the term of this patent is extended or adjusted under 35 U.S.C. 154(b) by 128 days.

(21) Appl. No.: 15/724,972

(22) Filed: Oct. 4, 2017

(65) Prior Publication Data

US 2018/0161806 A1 Jun. 14, 2018

(30) Foreign Application Priority Data

Dec. 14, 2016 (GB) ..... 1621236.7

(51) Int. Cl.

| | |
|---|---|
| ***B05D 1/32*** | (2006.01) |
| ***F01N 3/28*** | (2006.01) |
| ***B05C 21/00*** | (2006.01) |
| ***B05D 1/36*** | (2006.01) |
| ***F01N 3/10*** | (2006.01) |

(52) U.S. Cl.

CPC ..... *B05D 1/32* (2013.01); *B05C 21/005* (2013.01); *B05D 1/36* (2013.01); *F01N 3/10* (2013.01); *F01N 3/2828* (2013.01); *F01N 2510/0682* (2013.01)

(58) Field of Classification Search

CPC ..... B05D 1/32; B05D 1/36

See application file for complete search history.

(56) References Cited

U.S. PATENT DOCUMENTS

| | | | | |
|---|---|---|---|---|
| 3,901,821 | A * | 8/1975 | Retallick | B01D 53/945 502/100 |
| 5,043,311 | A * | 8/1991 | Engler | B01D 53/945 423/213.5 |
| 6,821,492 | B1 | 11/2004 | Myers et al. | |
| 8,071,038 | B2 | 12/2011 | Girard et al. | |
| 8,491,966 | B2 | 7/2013 | Hasselmann | |
| 9,333,490 | B2 | 5/2016 | Kazi et al. | |
| 2002/0114940 | A1 | 8/2002 | Clemens et al. | |

(Continued)

FOREIGN PATENT DOCUMENTS

| | | |
|---|---|---|
| GB | 2524662 A | 9/2015 |
| JP | S6125644 A | 2/1986 |

OTHER PUBLICATIONS

"Catalytic Coating & Materials," DieselNet Technology Guide—Emission Control Catalysts, Retrieved Online at https://www.dieselnet.com/tech/cat_mat_php, Jun. 2005, 13 pages.

(Continued)

*Primary Examiner* — Nathan H Empie

(74) *Attorney, Agent, or Firm* — Geoffrey Brumbaugh; McCoy Russell LLP

(57) ABSTRACT

A method of applying a non-homogenous catalyst coating to a surface is provided. The method may include partially masking the surface with a first template; applying a first washcoat slurry to those parts of the surface not masked by the first template; partially masking the surface with a second template; and applying a second washcoat slurry to those parts of the surface not masked by the second template.

12 Claims, 5 Drawing Sheets

(56) References Cited

U.S. PATENT DOCUMENTS

| | | | | |
|---|---|---|---|---|
| 2003/0190408 | A1* | 10/2003 | Moini | B01J 19/0046 427/8 |
| 2004/0254071 | A1 | 12/2004 | Yan et al. | |
| 2005/0085384 | A1 | 4/2005 | Myers et al. | |
| 2005/0143258 | A1* | 6/2005 | Bruck | B01D 53/885 502/439 |
| 2006/0083927 | A1 | 4/2006 | Von Ehr, II | |
| 2008/0124514 | A1 | 5/2008 | Fujdala et al. | |
| 2014/0271429 | A1 | 9/2014 | Kazi et al. | |
| 2015/0033715 | A1 | 2/2015 | Markatou et al. | |

OTHER PUBLICATIONS

Intellectual Property Office of the United Kingdom, Combined Search and Examination Report Issued in Application No. GB1621236.7, dated Jun. 30, 2017, South Wales, 6 pages.

* cited by examiner

RELATING TO FLOW OPTIMIZED WASHCOATING

CROSS REFERENCE TO RELATED APPLICATION

The present application claims priority to Great Britain Patent Application No. 1621236.7, filed Dec. 14, 2016. The entire contents of the above-referenced application are hereby incorporated by reference in its entirety for all purposes.

FIELD

The present disclosure relates to improvements in, or relating to, flow optimised washcoating and, in particular, to flow optimised washcoating for non-homogenous automotive exhaust flow.

BACKGROUND/SUMMARY

Combustion engines may generate harmful emissions. For example, diesel engines are known to emit carbon monoxide (CO), nitrogen oxides (NOx), unburned hydrocarbons (HC), and particulate matter (PM). Catalysts may be provided on various surfaces in the exhaust flow path of a vehicle in an attempt to reduce, or eliminate these emissions. These catalysts may help facilitate reactions that take place in the exhaust flow in order to ensure that the gases that are eventually emitted from the vehicle fulfil the increasingly stringent emission legislation and/or carbon dioxide fleet average targets or emission and carbon dioxide city or market incentive targets.

In order to optimise catalysed reactions within the exhaust pathway, the inlet and outlet cones may be designed to encourage uniform gas flow across the catalyst. In addition, flow obstructions may be provided within the exhaust pathway to try to improve the flow characteristics of the exhaust gases. However, such design constraints on the inlet and outlet cones and the obstructions all have implications on the packaging requirements of the exhaust system. These packaging requirements may conflict with other engine and/or vehicle design targets. For example they may compete with increasingly separate vehicle structural integrity and passenger safety measures, in particular in the event of a crash.

In applications where catalyst is applied homogeneously across a surface, a front face or area of the catalyst surface may degrade more rapidly than other parts of the catalyst surface. Therefore, in order to meet in-use compliance there has been a need to add to the catalyst volume. However, this may be at the expense of packaging requirements, as the overall system volume may be increased. Zone wash-coating on the substrate surface has therefore been used for catalyst washcoating. Traditional zone coating encompasses the provision of an increased concentration of catalyst on the first part of the surface which the exhaust gases are incident on, during use. This zone coating acknowledges that the front part of the surface may degrade more quickly as it may be the first part of the surface on which the exhaust gases are incident. The exhaust gases may contain the highest level of contaminants and the highest temperatures as they impact this part of the catalyst surface. The loading of the catalyst to the front of the catalyst surface may also enable the exploitation of heat flux efficiencies during catalyst light off as well as enabling catalyst volume reduction and/or catalyst material optimisation (reduce use of high value catalyst content).

Traditional zone coating may effectively increase the lifespan of catalyst surfaces by providing an increased catalyst concentration in the front part of the surface. Traditional zone coating assumes that the flow of the exhaust gases is substantially homogenous. However, inventors herein have recognized that failure modes in catalyst surfaces within exhaust systems tend to show that the flow of exhaust gases may be non-homogenous and largely attributable, but may not be exclusively attributable to the aforementioned constraints, for example attributable to additional exhaust systems bends resulting from added hardware and packaging constraints. Non-homogeneous flows may also result from some optimisations of engine design.

U.S. Pat. No. 9,333,490 to Kazi et al. discloses a zoned catalyst for diesel applications. An oxidation catalyst composite is disclosed wherein two washcoat zones differ by particular Pt/Pd ratios, and particular length ratios. However, the inventors herein have recognized shortcomings with this approach. For example, the relative locations of the zones differ only in that the first zone is upstream from the second zone, and the zoned surface is oriented only longitudinally with the exhaust flow direction.

According to the present disclosure there is provided a method of applying a non-homogenous catalyst coating to a surface, the method may include: partially masking the surface with a first template; applying a first washcoat slurry to those parts of the surface not masked by the first template; partially masking the surface with a second template; and applying a second washcoat slurry to those parts of the surface not masked by the second template. In this way, the surface may have a catalyst material that differs along a direction transverse to the exhaust flow direction, and may differ in both a longitudinal and transverse direction. Also in this way, the catalyst material may be varied on the surface in particular ways that may be better suited for non-homogeneous flow.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 shows an example of a catalyst surface which could see abnormal degradation due to the non-homogenous flow it is presented with.

DETAILED DESCRIPTION

The following description relates to embodiments of a method and a set of templates that may be used for washcoating a surface with a slurry to apply a catalyst to the surface. The surface may be positioned in an exhaust flow path of an internal combustion engine, for example a diesel engine. The surface applied according the present disclosure may include at least two areas that may meet at a specified border, and in specified pattern(s). In this way, the surface of the catalyst material may perform in specified and advantageous ways, and in may be particularly effective when exposed to non-homogeneous flow.

Figure 1A:
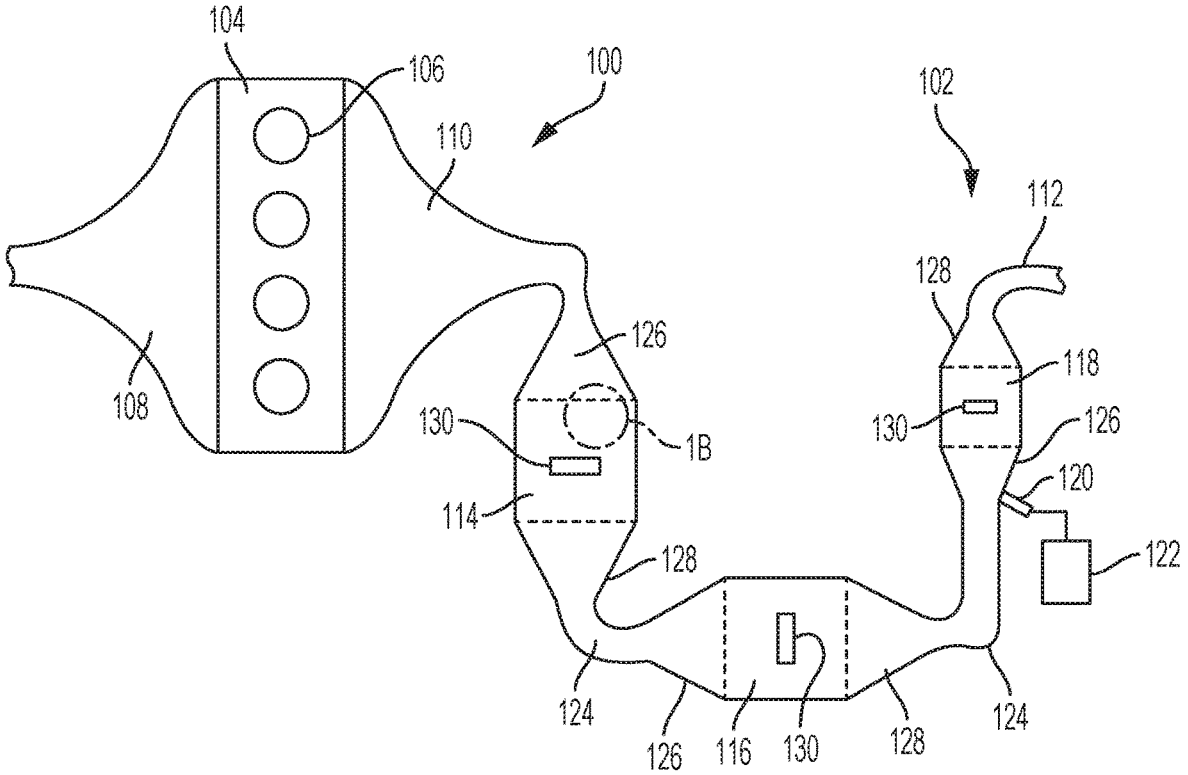
FIG. 1A is a schematic diagram illustrating portions of an engine and some example components of the exhaust flow path in accordance with the present disclosure.

FIG. 1A is a schematic depiction of portions of an example engine 100 including example components of, and example layout of, components along the exhaust path 102 of the engine 100. The engine 100 may include an engine block 104 with, for example, four cylinders, or combustion chambers 106. Air may enter the combustion chambers 106 via an intake manifold 108, and after mixing with a fuel and combusting in the combustion chambers 106 a flow of exhaust may be directed along the exhaust path 102 via an exhaust manifold 110. Various exhaust components may be positioned along the exhaust path 102 which may contribute to reducing harmful emissions that may enter the atmosphere via a tailpipe 112. Example exhaust components may include, but may not be limited to, a Diesel Oxidation Catalyst (DOC) 114, a Catalyzing Soot Filter (CSF) 116, and a Selective Catalytic Reduction element (SCR) 118. These exhaust components may include various surfaces that may include one or more catalysts applied thereon in accordance with the present disclosure. In addition, there may be a valve 120 that may spray a diesel exhaust fluid into the exhaust steam a part of the emission control features. The diesel exhaust fluid may be housed in a tank 122.

The exhaust path 102 may include various bends and turns 124 that may be necessary due to various engine and vehicle constraints. Each of the exhaust components may include an inlet 126, which may be configured, for example as an inlet funnel. And each of the exhaust components may include an outlet 128, which may be configured, for example as an outlet funnel. In addition, each exhaust component may include one or more obstructions 130 which may be include to modify the flow.

Figure 1B:
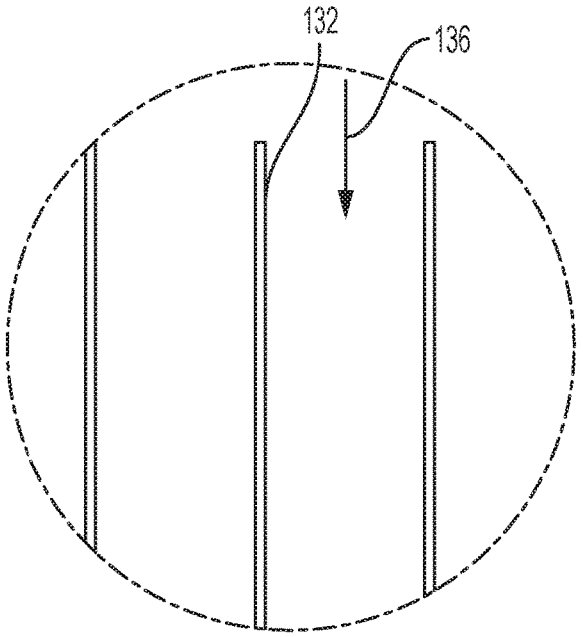
FIG. 1B is a blown up detailed view of a portion of FIG. 1A.

FIG. 1B is a blown up detailed view of a portion of FIG. 1A. An example surface 132, which may be washcoated in accordance with the present disclosure, is shown oriented substantially parallel with a flow direction, for example, a general flow direction 136 of the exhaust passing through the exhaust path 102.

Embodiments may provide a method of applying a non-homogenous catalyst coating to a surface. The method may include partially masking the surface with a first template, and applying a first washcoat slurry to those parts of the surface not masked by the first template. The method may also include partially masking the surface with a second template; and applying a second washcoat slurry to those parts of the surface not masked by the second template.

The step of applying the first washcoat slurry and/or the step of applying the second slurry washcoat may include applying slurry in a single pass.

The step of applying the first washcoat slurry and/or the step of applying the second slurry washcoat may include applying slurry in more than one pass. The step of applying the first and/or second washcoat slurry in more than one pass may include focussing on a front portion of the surface. In this way the front portion may be less prone to degrade. And also in this way using the templates in accordance with the present disclosure, the effects of inhomogeneous flow of exhaust gases may be better addressed. The method may further comprise the step of removing the first template, prior to the step of partially masking the surface with a second template.

The first template may be configured to cover the low velocity gradient contours of the surface. Therefore the catalyst laid down when the first template is in place is the high velocity areas. This irregular shape may be modelled from data of deterioration, or wear, on existing exhaust systems, and/or in separate applications modelled from separate systems, and can be mapped with representative flow simulation. Alternatively or additionally, the shape can be developed from analysis in developing new exhaust systems and for gas and diesel engines including those installed in, for example plug-in hybrid electric vehicles (PHEV).

Embodiments may provide a method of coating a surface of a catalyst that may include positioning a first template within a first washcoat dosing head. The first template may be configured for allowing a second portion of the surface to be dosed with a first slurry and substantially preventing a first portion of the surface from being dosed with the first slurry. The method may also include positioning a second template within the first washcoat dosing head, or a second washcoat dosing head. The second template may be configured for allowing the first portion of the surface to be dosed with a second slurry and substantially preventing the second portion of the surface from being dosed with the second slurry.

In some embodiments, the first and second templates may each include a blocking cross-sectional portion to substantially prevent slurry from passing, and a substantially unobstructed cross-sectional portion wherein the slurry is able to pass. The respective size and shape of the blocking and substantially unobstructed cross-sectional portions may be determined by simulating a flow velocity gradient of an exhaust gas flowing past the surface to be washcoated. Then, the method may include selecting a velocity threshold from the velocity gradient assigning an area wherein the simulated velocity is below the threshold to correspond with the blocking cross-sectional portion for the first template, and the substantially unobstructed cross-sectional portion for the second template; and assigning an area wherein the simulated velocity is above the threshold to correspond with the blocking cross-sectional portion for the second template, and the substantially unobstructed cross-sectional portion for the first template. In this way, the catalyst surface may be tailored to the flow as simulated and the flow to be expected in use.

In some embodiments, the first and second templates may each include a blocking cross-sectional portion to substantially prevent slurry from passing, and a substantially unobstructed cross-sectional portion wherein the slurry is able to pass. The respective size and shape of the blocking and substantially unobstructed cross-sectional portions may be determined by measuring a degree of catalytic material wear on selected areas of one or more selected used exhaust treatment devices to collect wear data. The method may include determining a wear threshold from the wear data. Then the method may include assigning an area wherein the wear is below the wear threshold to correspond with the blocking cross-sectional portion for the first template, and the substantially unobstructed cross-sectional portion for the second template; and assigning an area wherein the wear is above the wear threshold to correspond with the blocking cross-sectional portion for the second template, and the substantially unobstructed cross-sectional portion for the first template. In this way, the catalyst surface may be tailored in an attempt to mitigate wear on a new exhaust component based on the wear profile of one or more older used exhaust components of similar layout.

The second template may be configured to cover the high velocity gradient contours of the surface. Therefore the catalyst laid down when the second template is in place may cover the low velocity areas.

The second washcoat slurry may have a different composition from the first washcoat slurry. In particular, the second washcoat slurry may have a lower platinum group metal (PGM) content than the first washcoat slurry. The second washcoat slurry may also have the same PGM content as the first washcoat slurry. This second washcoat slurry may be more cost effective than a higher PGM content slurry required for the first washcoat slurry.

With some example embodiments substantially all of the surface may be covered by a combination of the first and second template. The first and second templates may be effectively inverses of one another, or complementary shapes filling a complete shape. Other example embodiments may utilize three or more templates. In this way, particular catalyst configurations may be achieved which may be particularly well suited for different, and/or specific, gas flows, for example spinning or so called corkscrew type gas flows. In such cases, as described in the case of two templates substantially all of the surface may, or may not, be covered by a combination of the three or more templates. The number of templates may effectively be complementary shapes and may fill, or complete, a predetermined shape.

The method may further comprise the step of orienting, for example registering, the second template after the step of partially masking the surface with the second template. This ensures that the intended alignment between the first and second template is achieved.

The method may further comprise the step of stabilisation of the catalyst. The method may further comprise the step of drying the catalyst. The method may further comprise the step of calcining the catalyst.

Figure 2:
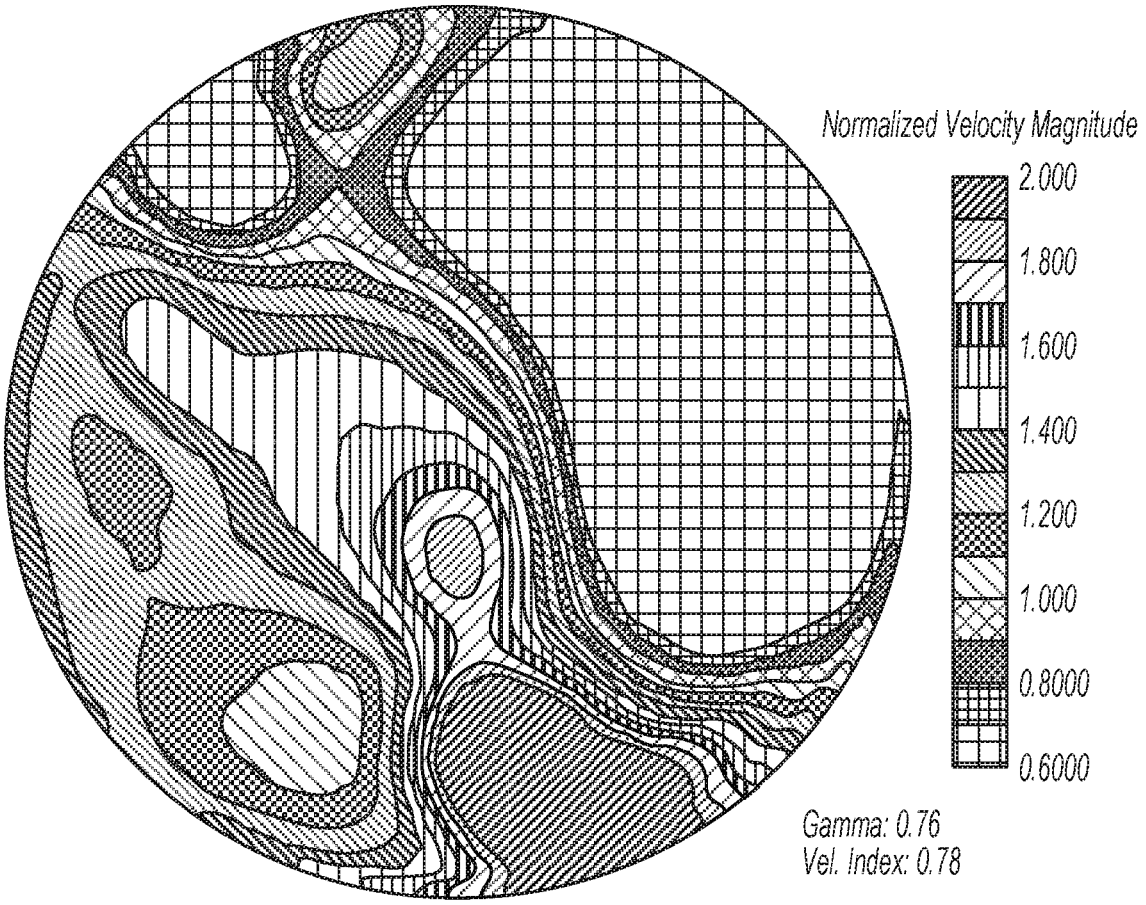

FIG. 2 shows an example of catalyst degradation resulting from non-uniform flow of exhaust gases. Improved catalyst utilisation may provide excellent flow uniformity and equal velocity index over a catalyst face to ensure that there are no dead zones. If these criteria are met then the catalyst may age uniformly.

The high density velocity magnitude indicates an increased proportion of the gas will pass through these areas of a flow-through catalyst or wall-flow filter. Emissions may break-through first in the localised areas of high flow. These regions may therefore be prone to more rapid catalyst deactivation, which may reduce the overall lifespan of the part.

Figure 3:
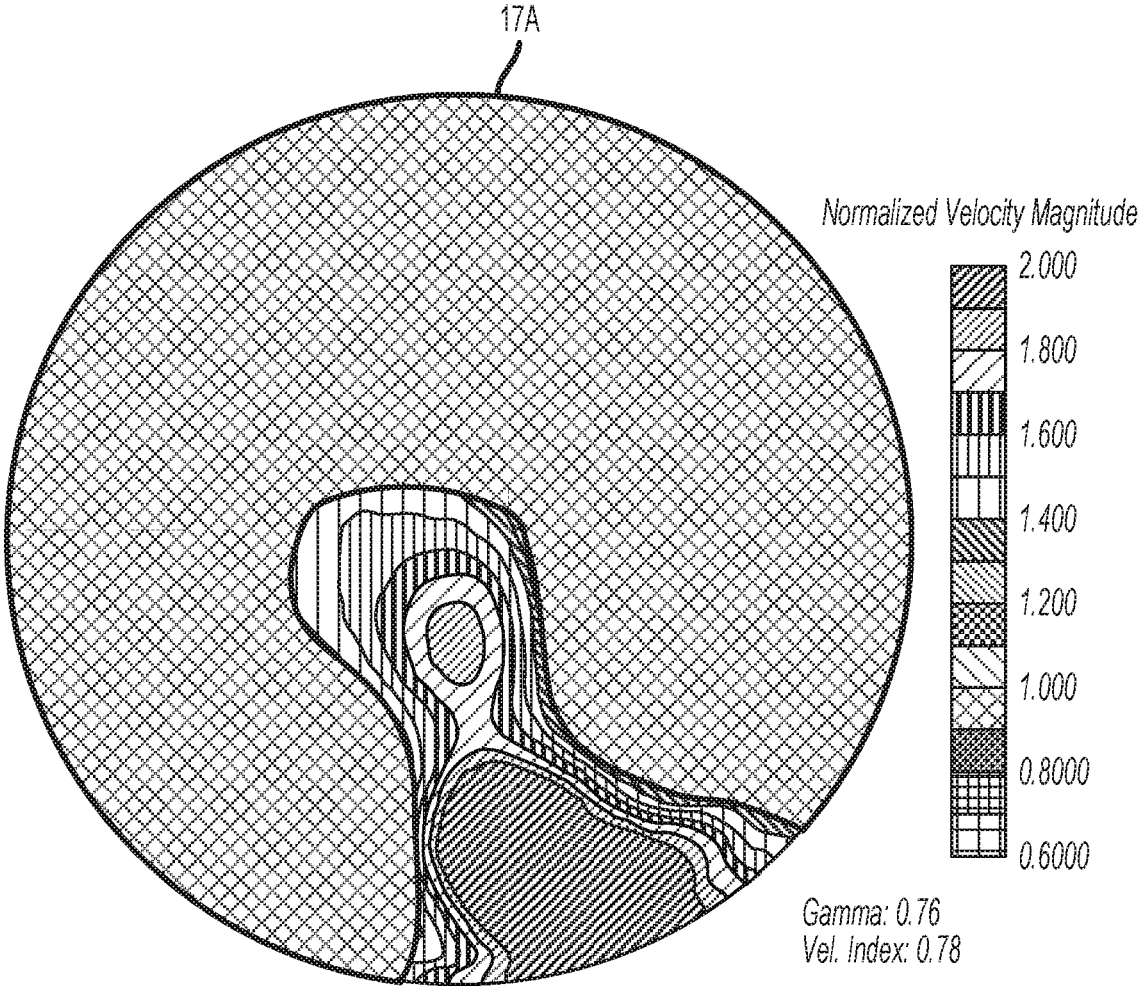
FIG. 3 illustrates a top view of a first template which may be used with the method in accordance with the present disclosure.

FIG. 3 shows a first template 17A that may be configured to cover low velocity gradient contours on the catalyst surface. Therefore, when the washcoat is applied, only the high velocity gradient areas may receive washcoat. The washcoat may be applied as a single pass or in multiple passes. For example, two, three, four or five, or more, passes may be deployed.

Figure 4:
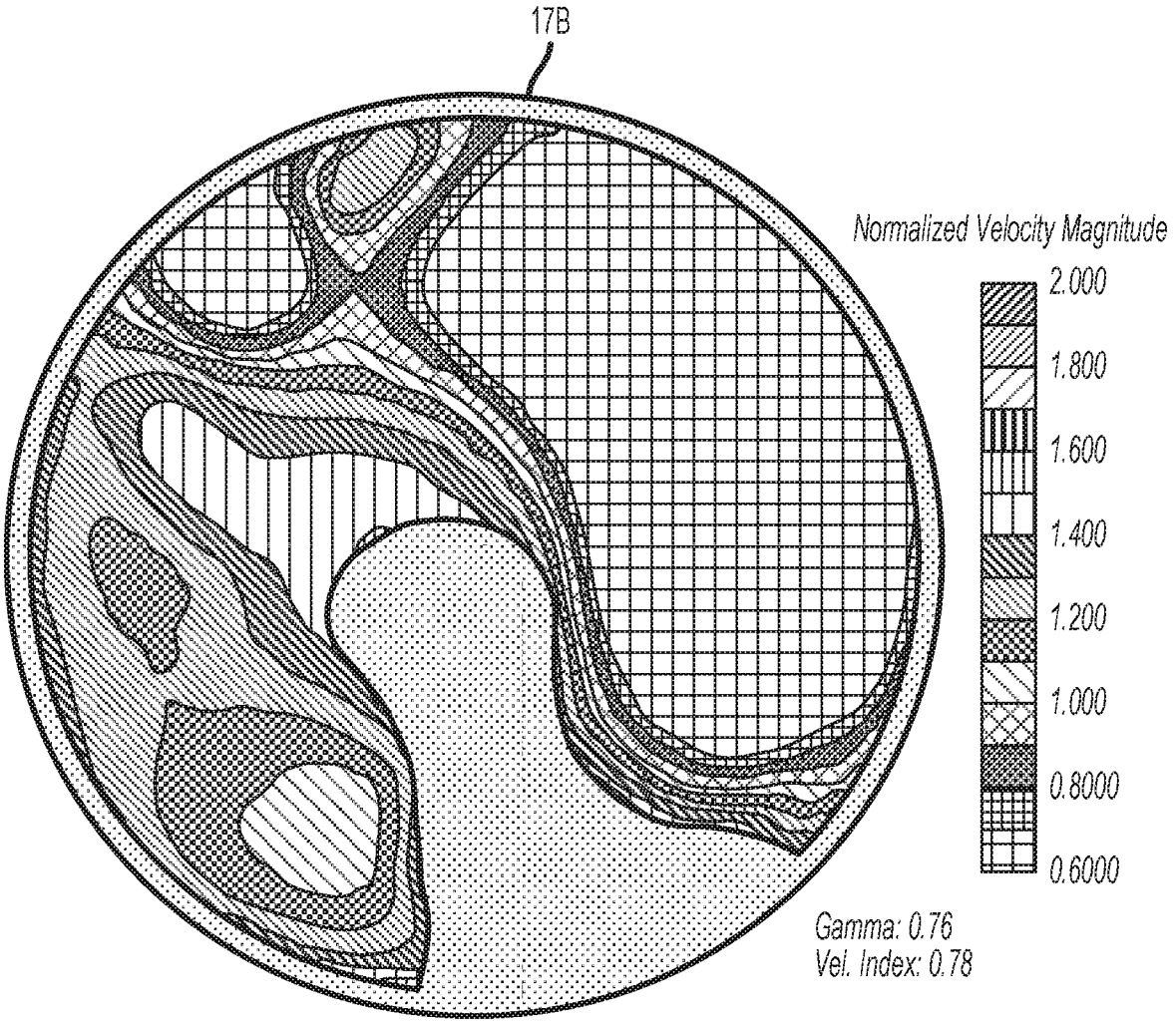
FIG. 4 illustrates a top view of a second template which may be used with the method in accordance with the present disclosure.

FIG. 4 shows a second template 17B that may be configured to cover high velocity gradient contours on the catalyst surface. Therefore, when the washcoat is applied, only the low velocity gradient areas may receive washcoat. The washcoat may be applied as a single pass or in multiple passes. For example, two, three, four or five passes may be deployed. Because the second template is used to coat the low velocity gradient areas, it can be a less robust catalyst. For example, it may be a catalyst with a lower Platinum Group Metals (PGM) content. The choice of binder stabilisers, promoters, zeolites etc (washcoat components) may also be selected on the basis of cost effectiveness rather than requiring the optimum.

Figure 5:
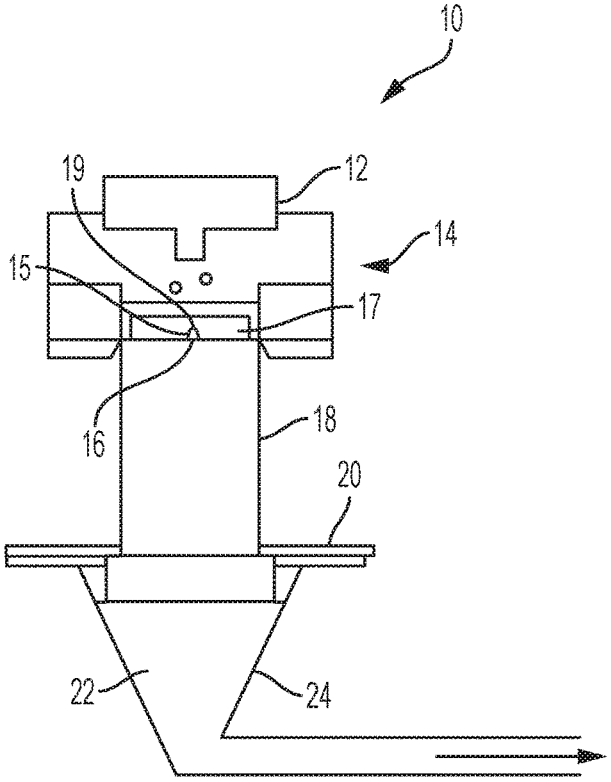
FIG. 5 shows apparatus that can be used to carry out the method in accordance with the present disclosure.

FIG. 5 shows an example apparatus that can be used to carry out the method of the present invention. The apparatus 10 comprises a dosing head 12, a liquid containment section 14, a membrane 16 on which a template 17 can be positioned, a catalyst substrate 18, a work table 20, a base 22 and a vacuum hood 24. The apparatus 10 may enable washcoats to be dosed in stages referred to as passes or coats. The number of passes may be selected to optimise the catalyst loading, in particular, to ensure the correct level of PGM across the catalyst surface. The optimum number of passes may depend on the catalyst loading within the washcoat slurry; the binder used to hold the catalyst within the slurry; and the required catalyst loading of the surface to be coated.

The washcoat slurry may be introduced to the apparatus 10 through the dosing head 12. It may be drawn through the apparatus 10 by a vacuum hood 24 provided below the base 22. The washcoat slurry may pass through the liquid containment section 14 and may be applied to the catalyst substrate 18.

By applying a template 17 on the membrane 16, only those parts of the surface not masked by the template 17 may receive catalyst. The template 17 may have a sufficient thickness to ensure that the flow of the washcoat slurry may be effectively blocked from the areas covered by the template. For example, in an apparatus 10 deploying a dosing head 12 that is 30 cm high, the template 17 might extend in the region of 8 to 12 cm through the dosing head. The extent of the template 17 may be selected to ensure that the slurry is channelled correctly.

It may be preferable to select the extent of the template 17 such that the washcost slurry has a homogeneous distribution in the final 10% to 30% of the surface. This could be achieved by having a shorter template, for example 4 to 9 cm. When using a shorter template 17, the front face of the surface may be inhomogeneous and may match the flow distribution of the template 17, but the final section of the surface, which will be the furthest from the exhaust gas input in use, may be closer to a homogenous distribution. This could be advantageous if the inhomogeneity of the flow is strongly weighted to the front part of the substrate. Therefore the optimisation of the catalyst distribution may be most strongly required at the front face of the substrate and a more homogeneous distribution may be acceptable at the back part of the catalyst substrate.

After a first template has been used and a suitable number of passes of catalyst have been dosed onto the surface, the first template can be removed and a second template applied to the membrane 16. The second template may cover a different part of the surface from the first template. In the example shown in FIGS. 3-4, the templates are effectively inverses of one another so that all of the surface is covered by one of the templates, but substantially none of the surface is covered by either both or neither of the templates. This may ensure that each part of the surface may be coated with either the first or the second template in position.

In order to ensure that the second template covers the correct part of the surface, methods in accordance with the disclosure may include orienting the second template. This may be achieved using a locator pin 15. The locator pin 15 may interface with a protrusion 19 on the membrane to ensure that the template is correctly oriented. Neither the first nor the second template may be rotationally symmetrical and therefore the orientation may be matched between the two templates to ensure that the intended catalyst coverage is obtained. Other orienting, or locating techniques may be used, techniques that may include, but may not be limited to, use of other mechanical means, lasers, and fluidic techniques.

Alternatively, or additionally, the washcoating with the second template can take place using a separate dosing head. An orientation step may be required, but it may require the orientation of the catalyst substrate relative to the dosing head as the orientation of the template relative to the dosing head may be predetermined.

The orientation of either the template, or the catalyst substrate, may be achieved visually or mechanically. For example, the template or substrate can be provided with a visual symbol that may be aligned to a predetermined point on the dosing head. Alternatively or additionally to the locator pin 15 illustrated in FIG. 5, a lug or notch in the metalwork on the template or the catalyst substrate may provide a mechanical notification of the correct positioning.

In a further example, not shown in the accompanying figures, the template based methodology could be combined with zone coating in order to provide an increased catalyst deposition in the unmasked front parts of the catalyst substrate in comparison with a reduced level of catalyst deposition at the rear part of the catalyst substrate, although still demonstrating the template shape of catalyst distribution.

Figure 6:
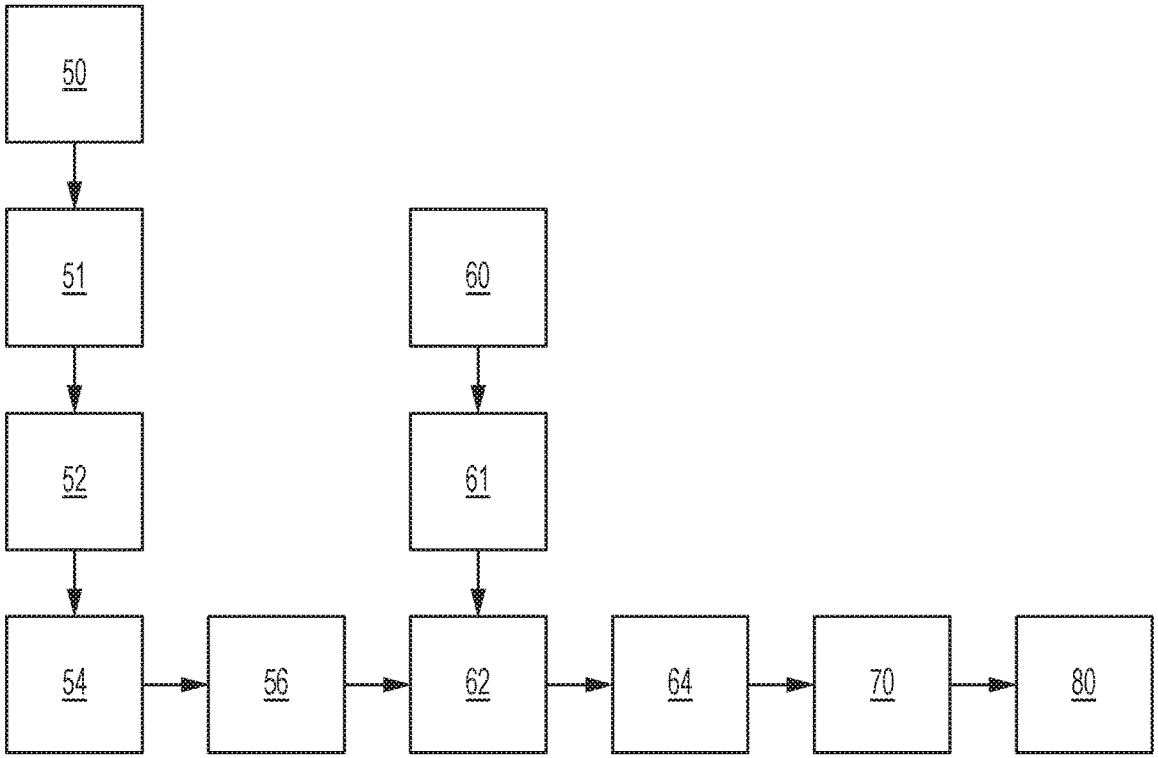
FIG. 6 is a flow diagram illustrating an example method in accordance with the present disclosure.

FIG. 6 is a flow diagram illustrating an example method, or portions of a method in the washcoating process flow in accordance with the disclosure. The first washcoat slurry may be prepared at step 50. The first washcost slurry 51 may then be dosed over template 1 at step 52. A stabilisation step 54 may follow the application of the first washcoat slurry 51. This stabilisation step 54 may encompass air being forced through the substrate to dry the catalyst which may ensure that the catalyst laid down on the surface by the dosing at step 52 is not disturbed by subsequent steps in the method. The manner in which the air is forced through may depend on the configuration of the apparatus being used. In a top down coating head as illustrated in FIG. 5, the air may be pulled through whereas in a bottom up coating method (not shown in the accompanying drawings) the air may be blown.

Once the first washcoat slurry 51 has been applied the surface may be brought into position to receive the second washcoat slurry. This may occur before, after, or during the stabilisation step 54. Depending on the configuration of the apparatus, it may encompass the transportation and insertion into a second dosing head that may already be provided with template 2. Alternatively, the template 1 may be removed from the dosing head and template 2 inserted.

Independent of the apparatus configuration, an orientation step 56 may be required. This may be executed visually or mechanically and it may be the orientation of the catalyst surface relative to the dosing head and template 2 assembly or it may the orientation of template 2 relative to the dosing head in the scenario where the catalyst surface has not been moved during the stabilisation step 54.

The second washcoat slurry 61 may be prepared at step 60. This step may take place at the same time as step 50, or it may take place during the first dosing step 52. Once the second washcoat slurry 61 has been prepared at step 60, it may be dosed over template 2 at step 62. There may then be a subsequent stabilisation step 64 that may ensure that the catalyst laid down on the surface during dosing at step 62 is firmly affixed.

The stabilised surface may then be subjected to a drying step 70 and a calcination step 80.

Embodiments may provide a set of masking templates for washcoating a surface with a catalyst, for example surface 132 illustrated in FIG. 1B. The set of templates may include a first template 17A that may be configured to cover a first portion of the surface 132. The first portion of the surface 132 may be configured to be exposed to an exhaust gas having a relatively low velocity profile. The set of templates may include a second template 17B that may be configured to cover a second portion of the surface. The second portion of the surface 132 may be configured to be exposed to an exhaust gas having a relatively high velocity profile.

The first template 17A may be positionable into a washcoat slurry apparatus 10 for application of a first washcoat slurry onto the second portion of the surface 132. The second template 17B may be positionable into the washcoat slurry apparatus 10, or a second washcoat slurry apparatus, for application of a second washcoat slurry onto the first portion of the surface 132.

The first and second templates 17A, 17B may both positionable into the same washcoat slurry apparatus. The first and second templates may define complementary obstructing shapes that together may complete a cross-sectional area to fill an entire cross-sectional flow path wherein washcoat slurry is otherwise able to pass through the washcoat slurry apparatus 10.

One example embodiment of a set of masking templates for washcoating may include a third template configured to cover a third portion of the surface 132. The third portion of the surface may be configured to be exposed to an exhaust gas having, for example, a relatively intermediate velocity profile. In this way, enhanced allowance for non-homogeneous flow may be accomplished.

When placed on the membrane 16 the characteristics of the first and second templates include blocking areas that may extend at least partially transverse to a general flow direction 136 of the exhaust gas. In this way a level of preferred targeting of specific areas of the substrate 18 with the catalyst may be accomplished.

As illustrated in FIG. 1B, the surface 132 to be washcoated may be oriented sustantially parallel with a general flow direction 136 of the exhaust gas. The exhaust gas flow may be non-homogeneous at such a location.

Note that the example control and estimation routines included herein can be used with various engine and/or vehicle system configurations. Selected actions of the control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of applying a non-homogenous catalyst coating to a surface of a catalyst substrate, the method comprising:

determining a flow velocity gradient of an exhaust gas flowing past the surface of the catalyst substrate;

partially masking the surface of the catalyst substrate with a first template, wherein the first template is configured to cover velocity gradient contours of the surface of the catalyst substrate with normalized values less than 1.6;

applying a first washcoat slurry to those parts of the surface of the catalyst substrate not masked by the first template;

partially masking the surface of the catalyst substrate with a second template; and applying a second washcoat slurry to those parts of the surface of the catalyst substrate not masked by the second template.

2. The method according to claim 1, wherein at least one of:

applying the first washcoat slurry includes applying slurry in a single pass; and applying the second washcoat slurry includes applying slurry in a single pass.

3. The method according to claim 1, wherein at least one of:

applying the first washcoat slurry includes applying slurry in more than one pass; and applying the second washcoat slurry includes applying slurry in more than one pass.

4. The method according to claim 1, wherein applying the first or second washcoat slurry includes applying slurry in more than one pass and includes focusing on a front portion of the surface of the catalyst substrate, wherein the front portion is a portion of the catalyst substrate closest to an exhaust manifold.

5. The method according to claim 1, further comprising removing the first template, prior to partially masking the surface of the catalyst substrate with the second template.

6. The method according to claim 1, further comprising configuring the second template to cover velocity gradient contours of the surface of the catalyst substrate with normalized values greater than 1.5.

7. The method according to claim 1, further comprising selecting the first washcoat slurry to be of a first composition and selecting the second washcoat slurry to be of a second composition, wherein the second composition is different from the first composition.

8. The method according to claim 7, wherein the second composition has a lower platinum group metal (PGM) content than the first composition.

9. The method according to claim 1, wherein the surface of the catalyst substrate is able to be covered by a combination of the first or second template.

10. The method according to claim 1, further comprising orienting the second template after the step of partially masking the surface of the catalyst substrate with the second template.

11. The method according to claim 1, further comprising one or more of:

stabilizing the catalyst;

drying the catalyst; and calcining the catalyst.

12. A method of applying a non-homogenous catalyst coating to a surface of a catalyst substrate, the method comprising:

simulating a flow velocity gradient of an exhaust gas flowing past the surface of the catalyst substrate;

partially masking the surface of the catalyst substrate with a first template;

applying a first washcoat slurry to those parts of the surface of the catalyst substrate not masked by the first template;

partially masking the surface of the catalyst substrate with a second template, wherein the second template is configured to cover velocity gradient contours of the surface of the catalyst substrate with normalized values greater than 1.5; and applying a second washcoat slurry to those parts of the surface of the catalyst substrate not masked by the second template.

* * * * *